US007243591B2

(12) United States Patent
Dixen et al.

(10) Patent No.: US 7,243,591 B2
(45) Date of Patent: Jul. 17, 2007

(54) HYDRAULIC VALVE ARRANGEMENT

(75) Inventors: Carl Christian Dixen, Sydals (DK); Brian Nielsen, Soenderborg (DK)

(73) Assignee: Sauer-Danfoss Aps, Nordborg (DK)

( * ) Notice: Subject to any disclaimer, the term of this patent is extended or adjusted under 35 U.S.C. 154(b) by 0 days.

(21) Appl. No.: 11/246,817

(22) Filed: Oct. 7, 2005

(65) Prior Publication Data

US 2006/0081121 A1 Apr. 20, 2006

(30) Foreign Application Priority Data

Oct. 15, 2004 (DE) ..... 10 2004 050 294

(51) Int. Cl.
*F15B 11/08* (2006.01)
*F15B 13/044* (2006.01)

(52) U.S. Cl. ..... 91/465; 91/466

(58) Field of Classification Search ..... 91/433, 91/437, 459, 464, 465, 466
See application file for complete search history.

(56) References Cited

U.S. PATENT DOCUMENTS 3,470,692 A * 10/1969 Kamp ..... 91/465
3,759,145 A * 9/1973 Taylor ..... 91/465
4,407,122 A * 10/1983 Nanda ..... 91/455
4,537,220 A * 8/1985 Anderson ..... 91/433
4,569,272 A * 2/1986 Taylor et al. ..... 91/433
5,467,688 A * 11/1995 Maruyama et al. ..... 91/441
5,568,759 A 10/1996 Aardema ..... 91/461

FOREIGN PATENT DOCUMENTS

DE 195 48 943 7/1997
EP 0 809 737 B1 6/1999
JP 60-249708 12/1985

* cited by examiner

*Primary Examiner*—Thomas E. Lazo
(74) *Attorney, Agent, or Firm*—McCormick, Paulding & Huber LLP

(57) ABSTRACT

The invention concerns a hydraulic valve arrangement (1) with a working connection arrangement having a first working connection (A) and a second working connection (B), both working connections (A, B) being connectable with a hydraulic consumer (2), a supply connection arrangement having a pressure connection (P) and a tank connection (T), a first valve arrangement with a first valve (12), closing the pressure connection (P) or connecting it in a controlled manner with the first working connection (A) or the second working connection (B), a second valve arrangement with a second valve (16), closing the tank connection (T) or connecting it in a controlled manner with the first working connection (A) or the second working connection (B), and a control arrangement controlling the first valve arrangement and the second valve arrangement. In such a valve arrangement, it is endeavoured to achieve improved operation behaviour. For this purpose, at least with one of the two valves (12, 16) a working position can be set, in which the first and the second working connections (A, B) are connected with each other.

15 Claims, 3 Drawing Sheets

HYDRAULIC VALVE ARRANGEMENT

CROSS-REFERENCE TO RELATED APPLICATIONS

Applicant hereby claims foreign priority benefits under U.S.C. § 119 from German Patent Application No. 10 2004 050 294.3 filed on Oct. 15, 2004, the contents of which are incorporated by reference herein.

FIELD OF THE INVENTION

The invention concerns a hydraulic valve arrangement.

BACKGROUND OF THE INVENTION

A hydraulic valve arrangement with a working connection arrangement having a first working connection and a second working connection, both working connections being connectable with a hydraulic consumer, a supply connection arrangement having a pressure connection and a tank connection, a first valve arrangement with a first valve, closing the pressure connection or connecting it in a controlled manner with the first working connection or the second working connection, a second valve arrangement with a second valve, closing the tank connection or connecting it in a controlled manner with the first working connection or the second working connection, and a control arrangement controlling the first valve arrangement and the second valve arrangement is known from U.S. Pat. No. 5,568,759. The valve arrangement has two three-position valves, which can be controlled by a control unit via pilot valves. The first three-position valve controls the flow of hydraulic fluid from a pump to a consumer, while the second three-position valve controls the flow of hydraulic fluid from the consumer to a tank. The consumer has two pressure chambers, each being connectable with the pump or the tank via the three-position valves.

BRIEF SUMMARY OF THE INVENTION

The invention is based on the task of providing a hydraulic valve arrangement as described in the introduction, which has improved operation behaviour.

With a valve arrangement as mentioned in the introduction, this task is solved in that, at least with one of the two valves a working position can be set, in which the first and the second working connections are connected with each other.

This design gives more stable control behaviour, as the two working connections can be short-circuited, that is, connected with each other, without requiring an additional valve. Thus, an already available valve is used, which has a connection to each of the working connections. In this manner, a usually available valve and the connected fluid pipes can be saved. Further, branching areas in the fluid pipes are avoided, which are potential leakage spots. Saving one valve also simplifies the coordination of the time-based control of the valves. Thus, a smaller number of valves must be controlled. Also balancing processes in the fluid pipes of the saved valve are avoided. The mounting efforts of the hydraulic valve arrangement are reduced, as material is saved. As a whole, the operation behaviour of the valve arrangement improves, as the reduction of the number of fluid pipes means a reduction of the fluid to be supplied, so that with less branching of the fluid pipes also the pressure control is more efficient.

It is particularly preferred that in a working position, in which the first and the second working connections are connected with each other, the working connections are at the same time connected with one of the supply connections via the valve according to the invention. This working position of the valve enables a regenerative working of the hydraulic valve arrangement. A regenerative working mode occurs, when a consumer connected with the valve arrangement starts moving, causing pressure medium, which is no longer needed somewhere in the consumer, is again supplied to another place in the consumer. The regenerative working mode of the hydraulic valve arrangement contributes to improved operation behaviour. There is a distinguishing between regenerative lifting and regenerative lowering. The lifting and lowering relates to a hydraulic consumer, for example in the form of a piston-cylinder unit, which is connected with a load via the piston. During regenerative lifting, a piston moves in the consumer by means of the hydraulic pressure, a pressure chamber in the consumer, for example at the first working connection, expanding and another working chamber at the second working connection contracting. When now the first working connection and the second working connection are connected with each other via the first valve, then hydraulic fluid flows via this valve from the pressure chamber at the second working chamber into the pressure chamber of the first working connection. When the third connection to the pump was not available, a balancing process would take place between the two pressure chambers. As, however, the second pressure chamber does not contract to the same extent as the first pressure chamber expands, a demand for pressurised fluid occurs in the first pressure chamber. This pressurised fluid is supplied through the pressure connection, which is connected at the same time. The fact that the pressurised fluid escaping from the second pressure chamber is used causes that a smaller pressure amount must be supplied to the first pressure chamber from the outside. This involves the advantage that the valve arrangement reaches higher reaction speeds and that at the same time pump energy is saved. When, for example, the second valve is provided with the working position according to the invention, it is possible to create pressure-free working connections at the same time, as a pressure relief to the tank connection is provided by the second valve. This is, for example, used during regenerative lowering.

It is advantageous that at least one valve according to the invention exists in the form of a directional control valve. Directional control valves are suited for controlling the flow of a pressure means and thus influencing a movement of a working link in the form of a consumer in a fluid system. Piston slide valves and seated valves can be used as directional control valves.

Preferably, the valve according to the invention is a three-way valve. A three-way valve is a valve, which has a maximum of three controlled connections. These are, for example, an inlet, a first working connection and a second working connection or an outlet, a first working connection and a second working connection.

Preferably, at least one valve according to the invention is a four-position valve. A four-position valve has four working positions and can, for example, have the form of a slide valve.

It is preferred that the working positions of the valves according to the invention can be set independently of each other. This can be realised by means of a control device controlling each valve individually.

Preferably, at least one valve according to the invention can be activated by a servo valve. The servo valve, also called pilot valve, can be mechanically, electrically or hydraulically activated. The servo valve can interrupt the pressure pipe, so that the subsequent valve to be controlled is not activated by accident. In some applications this kind of redundant pressure means interruption is required to increase the safety of preventing a false tripping.

Preferably, the valve according to the invention can be controlled electro-hydraulically. A combined electro-hydraulic activation means that the valve is activated hydraulically via an electrically activated servo valve.

Preferably, a flow resistance in the pipe to the tank connection is larger than a flow resistance in the pipe to a working connection. This feature is an advantage, when it is desired to use the valve arrangement for regenerative lowering. The reduced flow resistance in both inlets of the working connections, which are connected with each other, causes that firstly the pressure means between the working connections equalise, before they flow off in the direction of the tank connection or are sucked in from the direction of the tank connection.

It is expedient that a throttle is arranged in the pipe to the tank connection. A throttle is a simple element with the purpose of changing a flow resistance in a pipe. The throttle can be a nozzle or a bleed or a combination of bleed and nozzle. Here, a nozzle is understood to be a device, which has a local flow resistance with gradual cross-section reduction. A bleed, however, changes the local flow resistance with stepwise cross-section reductions.

For practical reasons, the throttle is adjustable. This makes it possible to change the flow cross-section according to the need. For example, the throttle can be controlled by means of a solenoid valve and in dependence of the measured values of the available pressure sensors. The flow cross-section can then change continuously, until the desired flow resistance has been reached.

Preferably, a float position can be set, which connects the working connections with each other and at the same time with the tank connection, the flow of hydraulic medium to the tank connection being unhindered. Unhindered means that a possibly available throttle in the tank pipe is not active. In this way, the pressure means can flow in the pipe between the working connections, and at the same time, a pressure means demand or a pressure means surplus can be equalised through the connection to the tank. Thus, a free movability of the hydraulic consumer is ensured. This is called float position and is easily realised in the described manner.

Preferably, at least one of the valves according to the invention can be set to a neutral position, in which the working connections are neither connected with each other nor with the supply connection arrangement. Based on a neutral position, the operation mode "lifting" or "lowering" can be set. In order to get from the operation mode "lifting" to the operation mode "lowering", it is expedient to assume a neutral position as intermediary step. This has the advantage that all connections are then interrupted and a new working state can be chosen from that point.

For practical reasons, all working connections are located on the same side of a housing accommodating the valve arrangement. This makes it possible to lead out the piping for the working connections on the same side of the valve. Also, a simpler housing design can be realised, which keeps the mounting efforts small.

BRIEF DESCRIPTION OF THE DRAWINGS

In the following, the invention is described in detail on the basis of preferred embodiments in connection with the drawings, showing.

DETAILED DESCRIPTION OF THE INVENTION

Figure 1:
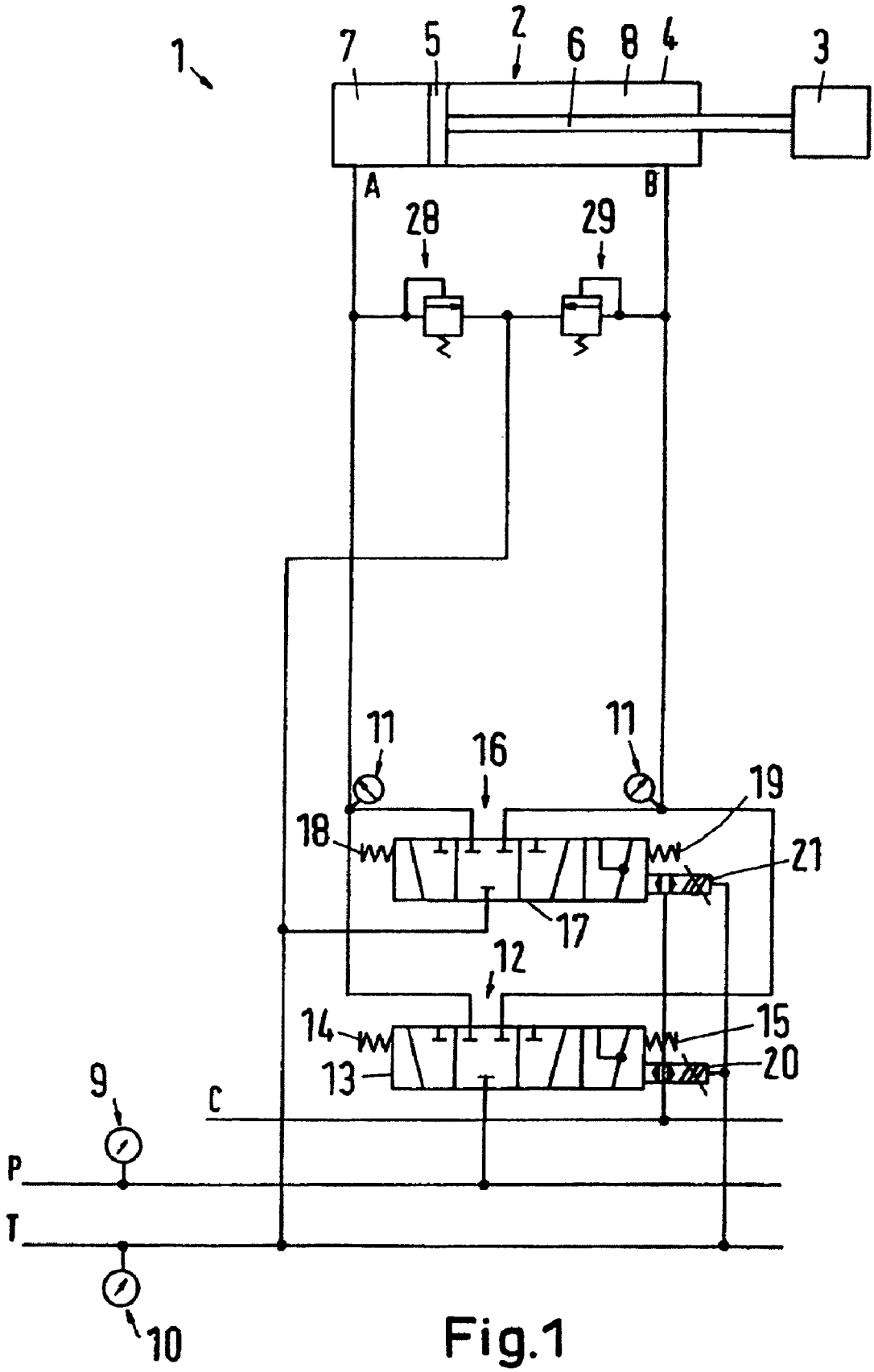
FIG. 1 is a schematic view of a first embodiment of a hydraulic valve arrangement.
Figure 2:
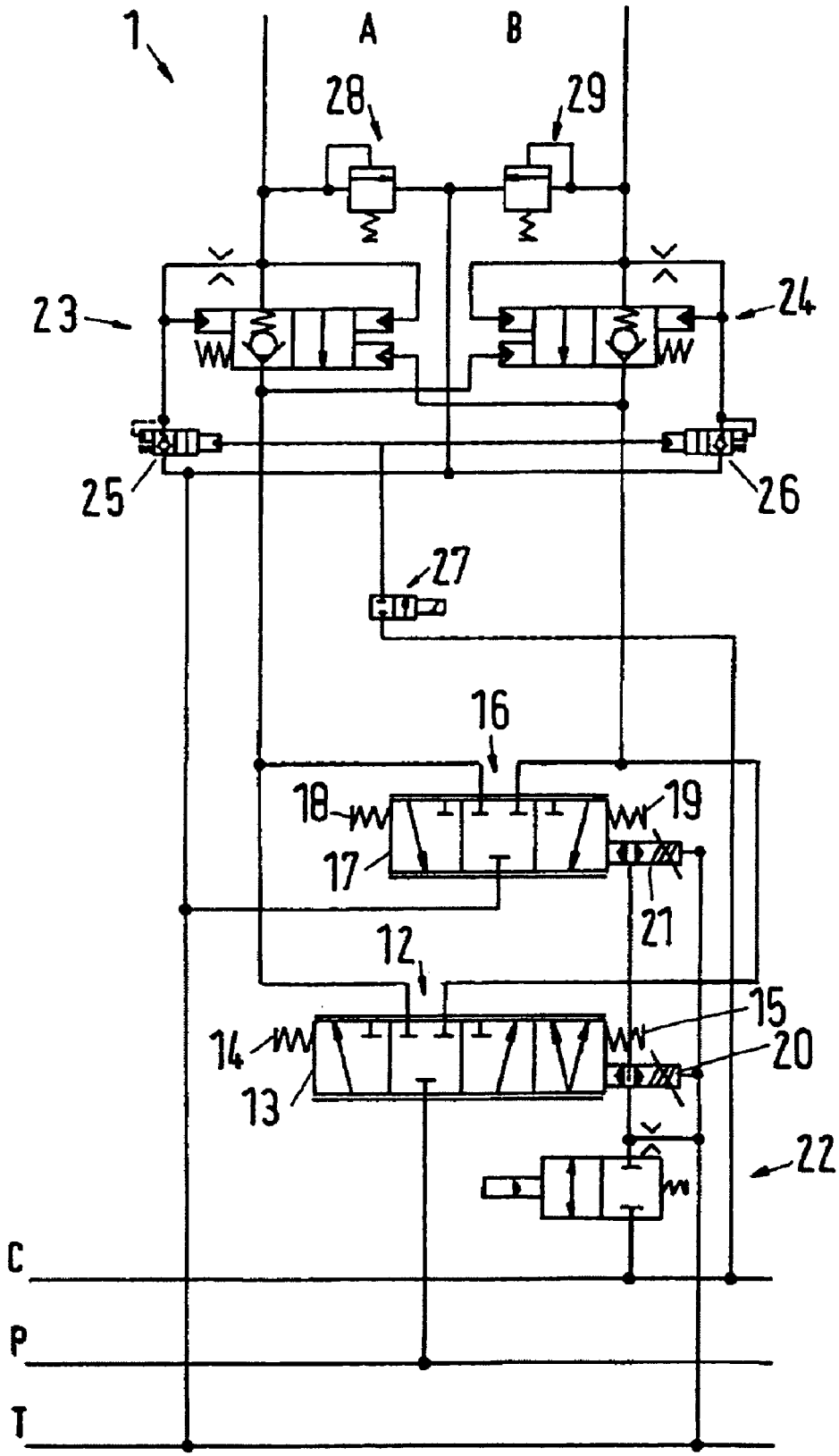
FIG. 2 is a schematic view of a second embodiment of a hydraulic valve arrangement.

FIGS. 1 and 2 show a hydraulic valve arrangement 1 with two working connections A, B, which are connected with a hydraulic consumer 2. In FIG. 1, the hydraulic consumer 2 is a piston-cylinder unit moving a load 3. For example, the piston-cylinder unit is used on a tractor to form a lifting device for a plough or another tool. However, the consumer can also be of another design, for example, at rotating motor.

The consumer 2 in FIG. 1 has a cylinder 4, in which a piston 5 is located. The piston 5 is connected on one side with a piston rod 6, which again influences the load 3. Accordingly, a first pressure chamber 7 occurs with a cross-sectional face, which is larger that the cross-sectional face of a second pressure chamber 8. The first pressure chamber 7 is connected with the working connection A, the second pressure chamber 8 is connected with the working connection B.

The pressure required for controlling the consumer is supplied via a pressure connection P, which can be connected with a pump or another pressure source, not shown in detail. At the pressure connection P, a pressure sensor 9 is provided, which determines a pressure, that is, the pressure at the pressure connection. In a tank connection T a pressure sensor 10 is located.

FIG. 1 shows further pressure sensors 11 by way of example, which determine further pressures. It is, however, not required for the operation of the valve arrangement 1 that pressure sensors are available in all the positions shown. Expediently, however, accommodations for pressure sensors will be provided in all the positions shown, and also in other positions. The pressure values determined can then be led to a control device controlling valves in dependence of the pressures.

The pressure connection P is connected with the two working connections A, B via a first valve 12. The first valve 12 in FIGS. 1 and 2 is a four-position valve and provided with a slide 13, which is held in its neutral position by springs 14, 15. In this neutral position, the connection between the pressure connection and the two working connections is interrupted. When the slide 13 is displaced, the first valve 12 optionally produces a connection between the pressure connection P and the first working connection A or between the pressure connection P and the second working connection B. In a further position, it is possible to connect the working connection A and the working connection B with each other and at the same time produce a connection to the pressure connection P.

A second valve 16 has the same design as the first valve 12, that is, it has a slide 17, which is held in the neutral position shown by spring 18, 19. In FIG. 1, the second valve 16, like the first valve 12, is a four-position valve. This four-position valve can optionally produce a connection between the tank connection T and the working connection or between the tank connection T and the working connection B. In a further position of the valve, it is also possible to connect the working connections A and B with each other and at the same time produce a connection of these two working connections to the tank connection T.

In FIG. 2, the second valve 16 is a three-position valve. When the slide 17 is displaced from a neutral position, it can connect the tank connection T with one working connection A or the other working connection B. In the neutral position of the slide 17 shown, the connection is, however, completely interrupted. However, there are cases, in which the connection is open in the neutral position.

It can also be imagined that the hydraulic valve arrangement 1 is made with a three-position valve as first valve 12 and a four-position valve as second valve 16. This means that the two valves 12, 16 in FIG. 2 are interchanged. Thus, with the additional position of the four-position valve 16, a connection between the working connections A and B is possible at the same time with a connection to the tank connection T.

In FIGS. 1 and 2, the valves 12, 16 can be controlled electro-hydraulically via drives 20, 21. Via pipes, these drives 20, 21 are connected with the connection C and the tank connection T. In FIG. 2, a servo valve 22 is connected in series with the first valve 12. The servo valve 22, also called pilot valve, has a magnet drive or another drive, which can be controlled by the control device. Also the second valve 16 can be provided with a servo valve. However, this is not shown here.

Regardless whether or not a pilot valve is connected in series with the valves 12, 16, the slides 13, 17 can be moved independently of each other. However, a pilot valve has the advantage that the oil supply controlling the valves 12, 16 can be interrupted after a position change, which gives further safety against the slide 13, 17 being inadvertently activated by the control pressure ruling in the connection C. A pilot valve 22 is optional and can be used anywhere, where valves with hydraulic pressures are controlled.

FIG. 2 additionally shows stop valves 23, 24, which can, for safety reasons, prevent movements of the consumer. Such stop valves are commonly known and not described in detail here. There are different possibilities of opening such stop valves 23, 24 again, one of which is shown in FIG. 2. Opening the stop valves 23, 24 takes place by means of the auxiliary valves 25, 26 and a second servo valve 27. It is also possible not to use the second servo valve 27 and instead to control the two auxiliary valves 25, 26 directly via auxiliary connections, which are located on the first or the second valve 12, 16. Opening is then controlled via a hydraulic pressure, which occurs as soon as the slide 13, 17 concerned is activated. The pressure chambers 7, 8 of the consumer 2 are protected against overloading via pressure limiting valves 28, 29.

Figure 3:
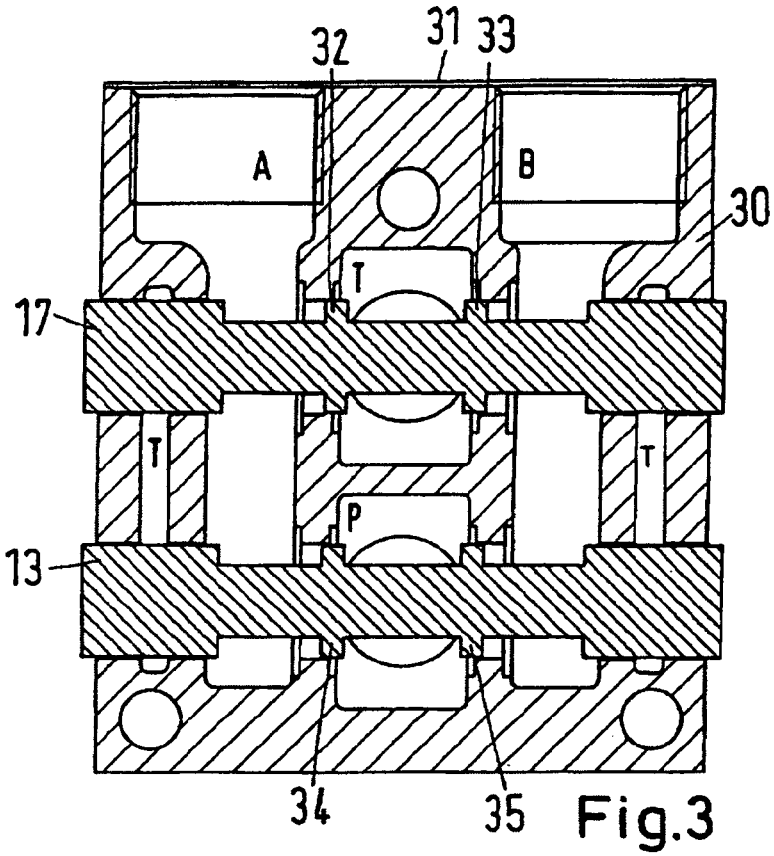
FIG. 3 is a schematic view of the design of a valve arrangement in the neutral position.
Figure 4:
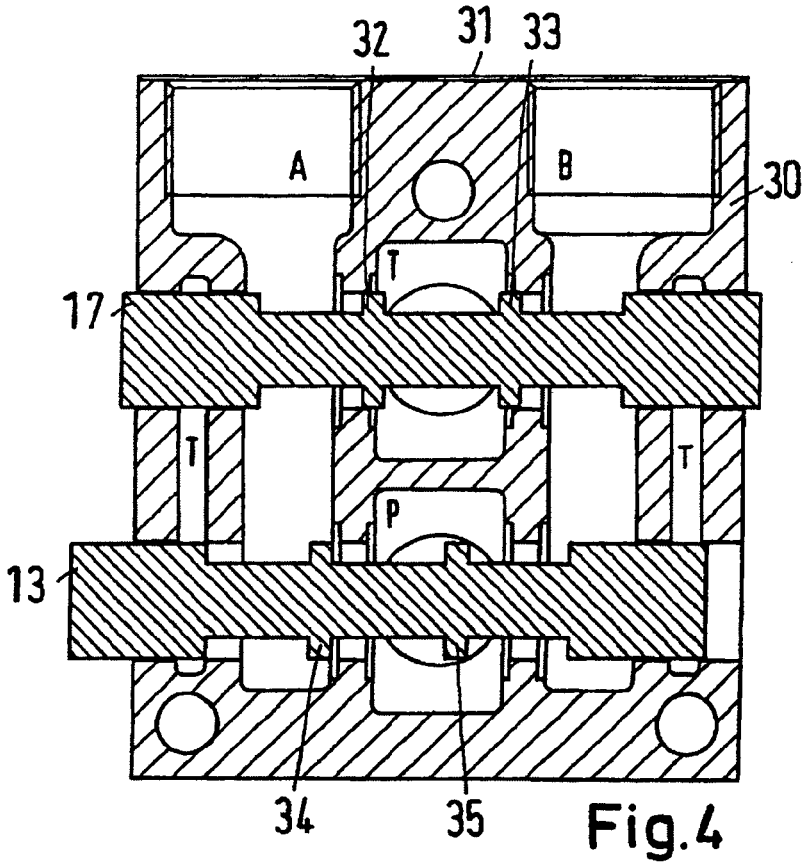
FIG. 4 is a schematic view of the design of a valve arrangement with regenerative lifting.

FIGS. 3 and 4 are schematic views of an embodiment of a mechanical design of such a valve arrangement 1. Same elements have the same reference numbers as in FIGS. 1 and 2. FIG. 3 shows a neutral position of the valve arrangement 1, whereas FIG. 4 shows a working position for regenerative lifting at the working connection B. The slides 13, 17 of the valves 12, 16 are arranged in parallel with each other in a housing 30. Further parts of the first and the second valve arrangement, for example pressure sensors, control lines or magnet drives, are not shown here. The two working connections A, B are located on the same front side 31 of the housing 30, which simplifies the mounting of connection pipes.

In the neutral position of the valve arrangement 1 according to FIG. 3, the working connections A, B are separated from each other by valve bleeds 32, 33 of the valve slide 17. At the same time, also the tank connection T is blocked by the valve bleeds 32, 33. In the lower area, valve bleeds 34, 35 of the valve slide 13 also separate the working connections A, B from each other. Further, the pressure connection P is separated from the working connections A, B by the valve bleeds 34, 35.

In FIG. 4, the valve slide 17 is in its neutral position, as also shown in FIG. 3. However, the valve slide 13 assumes a position, which ensures a connection between the working connections A and B and at the same time a connection to the pressure connection P. In this working position of the valve arrangement 1, it is now possible that the pressure medium, for example in the form of pressurised fluid, flows from connection A to connection B and that at the same time additional pressurised fluid flows from the pressure connection P in the direction of connection B. Due to the opening conditions at the valve bleeds 34, 35, these flow directions are predetermined. As the load was lifted at the working connection B, it is now possible to lower it again. For this purpose, the slide 13 is displaced to its neutral position, so that the connections A and B are separated from each other. Subsequently, the slide 17 is activated, so that both working connections A, B are connected with each other and at the same time are connected with the tank connection T. In this way, a regenerative lowering is possible. During regenerative lowering a throttle can be activated in the pipe to the tank connection T, so that with a negative, large load 3 a smooth and jerk-free movement of the load 3 is achieved.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A hydraulic valve arrangement with a working connection arrangement having a first working connection and a second working connection, both working connections being connectable with a hydraulic consumer, a supply connection arrangement having a pressure connection and a tank connection, a first valve arrangement with a first valve, alternately closing the pressure connection, connecting it in a controlled manner with the first working connection, or connecting it in a controlled manner with the second working connection, a second valve arrangement with a second valve, alternately closing the tank connection, connecting it in a controlled manner with the first working connection, or connecting in a controlled manner with the second working connection, and a control arrangement controlling the first valve arrangement and the second valve arrangement, wherein, at least with one of the two valves a working position can be set, in which the first and the second working connections are connected with each other.

2. The hydraulic valve arrangement according to claim 1, wherein in a working position, in which the first and the second working connections are connected with each other, the working connections are at the same time connected with one of the supply connections via at least one of the valves.

3. The hydraulic valve arrangement according to claim 1, wherein at least one of the valves exists in the form of a directional control valve.

4. The hydraulic valve arrangement according to claim 1, wherein the second valve is a three-way valve.

5. The hydraulic valve arrangement according to claim 1, wherein at least one of the valves is a four-position valve.

6. The hydraulic valve arrangement according to claim 1, wherein the working positions of the valves can be set independently of each other.

7. The hydraulic valve arrangement according to claim 1, wherein at least one of the valves can be activated by a servo valve.

8. The hydraulic valve arrangement according to claim 1, wherein at least one of the valves can be controlled electro-hydraulically.

9. The hydraulic valve arrangement according to claim 1, wherein a flow resistance in the pipe to the tank connection is larger than a flow resistance in the pipe to a working connection.

10. The hydraulic valve arrangement according to claim 1, wherein a throttle is arranged in the pipe to the tank connection.

11. The hydraulic valve arrangement according to claim 10, wherein the throttle is adjustable.

12. The hydraulic valve arrangement according to claim 1, wherein a float position can be set, which connects the working connections with each other and at the same time with the tank connection, the flow of hydraulic medium to the tank connection being unhindered.

13. The hydraulic valve arrangement according to claim 1, wherein at least one of the valves can be set to a neutral position, in which the working connections are neither connected with each other nor with the supply connection arrangement.

14. The hydraulic valve arrangement according to claim 1, wherein all working connections are located on the same side of a housing accommodating the valve arrangement.

15. A hydraulic valve arrangement comprising:

a working connection arrangement having a first working connection and a second working connection, both working connections being connectable with a hydraulic consumer;

a supply connection arrangement having a pressure connection and a tank connection;

a first valve arrangement with a first valve, configured to be set in at least three positions, including:

a first position in which the pressure connection is closed;

a second position in which the pressure connection is connected with the first working connection; and a third position in which the pressure connection is connected with the second working connection;

a second valve arrangement with a second valve, configured to be set in at least three positions, including:

a first position in which the tank connection is closed;

a second position in which the tank connection is connected with the first working connection; and a third position in which the tank connection is connected with the second working connection; and a control arrangement controlling the first valve arrangement and the second valve arrangement;

wherein, at least with one of the two valves a fourth position can be set, in which the first and the second working connections are connected with each other.

* * * * *